US010966038B2

(12) United States Patent
Callaway et al.

(10) Patent No.: US 10,966,038 B2
(45) Date of Patent: Mar. 30, 2021

(54) METHOD OF FITTING A HEARING DEVICE TO A USER'S NEEDS, A PROGRAMMING DEVICE, AND A HEARING SYSTEM

(71) Applicant: Oticon A/S, Smørum (DK)

(72) Inventors: Susanna Løve Callaway, Smørum (DK); Nicolas Le Goff, Smørum (DK); Terri Ives, Fredensborg (DK); Nimrod Bogdanovski, Smørum (DK); Mikkel Bo Rasmussen, Smørum (DK); Anders Meng, Smørum (DK); Martin Kuriger, Berne (CH); Meng Guo, Smørum (DK); Mikkel Grønbech, Smørum (DK); Mojtaba Farmani, Smørum (DK); Nels Hede Rohde, Smørum (DK); Stefan Gram, Smørum (DK); Sudershan Yalgalwadi Sreepadarao, Smørum (DK); Bernhard Kuenzle, Berne (CH)

(73) Assignee: OTICON A/S, Smørum (DK)

( * ) Notice: Subject to any disclaimer, the term of this patent is extended or adjusted under 35 U.S.C. 154(b) by 191 days.

(21) Appl. No.: 16/270,784

(22) Filed: Feb. 8, 2019

(65) Prior Publication Data

US 2019/0253817 A1 Aug. 15, 2019

(30) Foreign Application Priority Data

Feb. 9, 2018 (EP) ..... 18156176

(51) Int. Cl.
*H04R 25/00* (2006.01)

(52) U.S. Cl.
CPC ..... *H04R 25/70* (2013.01); *H04R 25/453* (2013.01); *H04R 25/505* (2013.01); (Continued)

(58) Field of Classification Search
CPC .. H04R 25/453; H04R 25/407; H04R 25/552; H04R 2225/021; H04R 25/402; H04R 25/405; H04R 2225/025
See application file for complete search history.

(56) References Cited

U.S. PATENT DOCUMENTS 9,338,561 B2 * 5/2016 Gran ..... H04R 25/405
9,432,778 B2 * 8/2016 Ma ..... H04R 25/552
(Continued)

FOREIGN PATENT DOCUMENTS

EP 1 708 544 A1 10/2006
EP 2 237 573 A1 10/2010
(Continued)

*Primary Examiner* — Amir H Etesam
(74) *Attorney, Agent, or Firm* — Birch, Stewart, Kolasch & Birch, LLP

(57) ABSTRACT

A method of conducting a fitting session for fitting a hearing device to a hearing device user's needs is provided. The method comprises S1. providing an estimate of, a current feedback from said output transducer to said input transducer, while the hearing device is in an operational state;

S2. evaluating said estimate of a current feedback and providing a value of a feedback risk indicator in dependence of said estimate of a current feedback;

S3. determining whether said value of the feedback risk indicator fulfils a high-risk criterion; and S4. if said high-risk criterion is fulfilled providing at least one of a warning, a recommendation, and an action in relation to said feedback risk.

Steps S1 to S4 are configured to be automatically performed as background processes.

Thereby a simplified scheme for fitting a hearing device to a user's needs may be provided.

29 Claims, 8 Drawing Sheets

(52) U.S. Cl.
CPC ..... *H04R 25/554* (2013.01); *H04R 25/558* (2013.01); *H04R 2225/55* (2013.01)

(56) References Cited

U.S. PATENT DOCUMENTS

2014/0185849 A1* 7/2014 Ma ..... H04R 25/453
381/318
2016/0100259 A1* 4/2016 Guo ..... H04R 25/30
381/60

FOREIGN PATENT DOCUMENTS

| | | | | |
|---|---|---|---|---|
| EP | 3 002 959 | A1 | 4/2016 | |
| EP | 3 139 636 | A1 | 3/2017 | |
| EP | 3 185 588 | A1 | 6/2017 | |
| WO | WO 2007/045271 | A1 | 4/2007 | |
| WO | WO 2008/000843 | A2 | 1/2008 | |
| WO | WO 2008/000843 | A3 | 1/2008 | |
| WO | WO 2008/151970 | A1 | 1/2008 | |
| WO | WO 2008000843 | * | 1/2008 | ..... H04R 25/00 |

* cited by examiner

METHOD OF FITTING A HEARING DEVICE TO A USER'S NEEDS, A PROGRAMMING DEVICE, AND A HEARING SYSTEM

SUMMARY

The present disclosure relates to automatic feedback risk evaluation and guidance to a hearing care professional (HCP) and/or to a user during fitting of a hearing device, e.g. a hearing aid, to a user's particular needs.

Today, a hearing aid user will experience feedback whenever the hearing aid fitting is not within specific tolerances. Any hearing aid with moderate to high gain has the probable bi-product of acoustic feedback. An HCP must pay careful attention to this feedback, so that the hearing aid user will not experience it. It requires the HCP to test for feedback with a variety of methods, which are time consuming: For example, running special feedback management tests or manually testing for feedback.

It would be advantageous to have a quicker and natural way of fitting hearing devices.

The present application describes a method/process/procedure (in the following referred to as 'the method') that allows a hearing aid fitting to proceed without requiring the HCP (and/or the hearing device user) to pay attention to feedback, unless necessary. The HCP (and/or the user) will be notified if there is a high risk of feedback. If this is the case, appropriate warnings, and/or recommended feedback preventive actions are provided to the HCP (and/or the user), or automatically implemented by the hearing system.

A Method of Fitting a Hearing Device to a User's Needs:

The main idea/concept for the present disclosure is: The HCP and/or the hearing device user should not actively pay attention to low-risk feedback problems during a fitting session. The hearing device can nevertheless be fitted according to the hearing device user's needs. However, a notification and/or recommendations of actions to manage the feedback will be issued, in case feedback-risk is judged by the system to be too high. Alternatively, preventive actions may be automatically implemented by the system.

In practice, the method consists of:

The hearing device/programming device makes evaluations of ongoing feedback situations and notifies the HCP and/or the user when a high feedback risk is detected.

Warnings and/or recommended actions are provided to HCP and/or the user upon identification of a high feedback risk detection.

In an aspect of the present application, a method of conducting a fitting session for fitting a hearing device to a hearing device user's needs is provided. The hearing device comprises an input transducer for picking up sound in the environment of the user and providing an electric input signal, and an output transducer for providing output stimuli perceivable to the user as sound based on a processed version of said electric input signal.

The method comprises

S1. providing an estimate of, a current feedback from said output transducer to said input transducer, while the hearing device is in an operational state;

S2. evaluating said estimate of a current feedback (e.g. in relation to a feedback criterion) and providing a value of a feedback risk indicator in dependence of said estimate of a current feedback;

S3. determining whether said value of the feedback risk indicator fulfils a high-risk criterion; and

S4. if said high-risk criterion is fulfilled providing at least one of a warning, a recommendation, and an action in relation to said feedback risk;

Steps S1 to S4 are configured to be automatically performed as background processes.

Thereby a simplified scheme for fitting a hearing device to a user's needs may be provided.

The term 'automatically performed as background processes' is intended to mean 'be performed essentially without intervention of the user of the fitting system/method' (e.g. a hearing care professional (HCP)). Steps S1 to S4 are configured to be automatically performed as background processes during the fitting session, such as during a major part of, or the entire fitting session. The term 'a background process' is in the present context taken to mean a computer process that is executed without a user's active involvement. The term 'a background process' is in the present context taken to mean a computer process that is executed without a user's (active) involvement. Such processes may e.g. include one or more of estimation, logging, system monitoring, scheduling, user notification, etc. The background processes may be executed by a computer without a user's active involvement.

The term 'an estimate of a current feedback' is intended to include an estimate of a (frequency dependent) transfer function or an impulse response (of sound or vibration) from the output to the (or an) input transducer.

The term 'while the hearing device is in an operational state' is in the present context taken to mean that the hearing device is ON (power is on), at least having functioning output and input transducers (capable of providing output stimuli, and picking up sound, respectively) allowing an estimate of current feedback to be determined. The hearing device (or devices) may be mounted on the user in a normal way (e.g. at or in the ear(s) of the user) during the fitting session, but this need not be the case. The hearing device (or devices) may alternatively be located on a support structure (e.g. a head and torso model, e.g. HATS, or on carrier, such as on a shelf or a table, or in a storage box).

The term 'a feedback criterion', e.g. a 'high-risk criterion', is intended to include

- comparison of the estimate of current feedback with pre-determined values of feedback (e.g. including a difference measure and/or a threshold value)
- comparison of the estimate of current feedback with values defined according to programmed gains in the hearing device (the gains in question are e.g. used to compensate for user's hearing loss),
- comparison of the estimate of current feedback with values defined according to the signal processing from input transducer to output transducer (signal processing may e.g. include noise reduction, beamforming to provide directional sound focus/removal, ear/transducer corrections etc.).

The 'feedback criterion' (e.g. the 'high-risk criterion'), e.g. its fulfillment, is related to the current feedback estimate ($H_{est}$). The feedback criterion may e.g. additionally be dependent on a current forward path gain (G) applied to an input signal by the hearing device before it leaves the hearing device as an acoustic signal. The feedback criterion may thus be a function (F) of current values of feedback estimate ($H_{est}$) and forward gain (G). The feedback criterion may comprise a logic expression related to $F(H_{est}, G)$.

A first exemplary specific 'feedback criterion' may e.g. be that 'current loop gain is compared to specific values of loop gain (and the closest value is identified)', e.g. −20 dB, −10 dB, −5 dB, 0 dB, +2 dB, +5 dB, +10 dB, and +20 dB. Loop gain (LG) is defined as $$LG=G+H,$$

where G is the desired forward path gain (e.g. to compensate for a hearing impairment of the user), whereas H is the feedback path gain (in a logarithmic representation, where levels are given relative to a common reference level; $LG=G\cdot H$ in a linear representation; typically, $0<H<1$ (corresponding to attenuation) in a linear representation, i.e. $H<0$ in a logarithmic representation), cf. e.g. FIG. 7. The desired forward path gain (G) is assumed to be known at any given time (e.g. as determined by a compressor in dependence of a user's frequency and level dependent need for amplification, and the hearing aid style in question). The feedback path is estimated ($H_{est}$) by a feedback estimation unit of the hearing device.

A second exemplary specific 'feedback criterion' may e.g. be that a 'current feedback estimate is compared to specific values of feedback (and the closest value is identified)', e.g. −60 dB, −40 dB, and −20 dB (e.g. (assumed to represent) a low, a medium and a high feedback value, respectively). A third exemplary specific 'feedback criterion' may e.g. be that a 'current feedback estimate is compared to predefined feedback values (and the closest value is identified)' (e.g. for a given hearing device style, the predefined feedback values e.g. representing a low, a medium and a high feedback value, respectively).

A 'feedback risk indicator' may e.g. be binary, e.g. 'low risk', 'high risk', or have several (e.g. more than two) risk-levels, e.g. 'low risk', 'medium risk' and 'high risk'. A 'feedback risk indicator' may e.g. be continuous, e.g. implemented as a value between 0 and 1, where values close to zero indicate a relatively low risk of feedback oscillations, values around 0.5 indicate a medium risk of feedback oscillations, and where values close to one indicate a relatively high risk of feedback oscillations.

A feedback risk indicator related to a feedback criterion based on loop gain (LG) may e.g. be 'low risk' for $LG<-10$ dB, a 'medium risk' for $-10\text{ dB}\leq LG<0$ dB, and 'high risk' for $LG\geq 0$ dB. A feedback risk indicator related to a feedback criterion based on the feedback estimate ($H_{est}$) directly may e.g. be 'low risk' for $H_{est}<-60$ dB, 'medium risk' for $-60\text{ dB}\leq H_{est}<-20$ dB, and 'high risk' for $H_{est}\geq -20$ dB.

As discussed above for the 'feedback criterion', the fulfillment of the 'high-risk criterion' may be (e.g. directly) related to the value of the current feedback estimate ($H_{est}$), e.g. 'the current feedback estimate is larger than or equal to a critical value' ($H_{est}\geq H_{crit}$). The 'high-risk criterion' may e.g. additionally be dependent on a current (desired) forward path gain (G) (intended to be applied to an input signal by the hearing device before it leaves the hearing device as an acoustic signal). The 'high-risk criterion' may thus be a function (F) of current values of feedback estimate ($H_{est}$) and forward gain (G). The 'high-risk criterion' may comprise a logic expression related to $F(H_{est}, G)$, e.g. $F(H_{est}, G)\geq X_{crit}$, or $F(H_{est}, G)\leq X_{crit}$, where $X_{crit}$ is a critical value above (or below) which the risk of build-up of feedback oscillations is expected to be imminent (and e.g. where some sort action should be contemplated). The function $F(H_{est}, G)$ may e.g. be related to loop gain, e.g. $F(H_{est}, G)=g(H_{est}+G)$, where g is a function. The high risk criterion may e.g. be $H_{est}+G\geq X_{crit}$, where $X_{crit}$ is a critical value of loop gain.

A 'high-risk criterion' related to loop gain may thus e.g. be that said current loop gain is larger than 0 dB, (as above, or alternatively larger than +2 dB, or larger than +5 dB, as the case may be). A 'high-risk criterion' related to the current feedback estimate may e.g. be that said feedback estimate is larger than or equal to −20 dB (as above, e.g. in a specific frequency range (or frequency band)).

Background Processes:

The feedback risk detection method/system run as a background process. During a fitting session, the HCPs/users are supposed go through different fitting stages, and not all of them are directly related to the feedback problem/handling. However, the feedback risk detection can run in all these fitting stages, without being visible/noticeable for HCPs/users. Only when/if the feedback risk detection estimates a high feedback risk, the HCPs/users are made aware of this and mitigation actions are recommended.

In an example use case, if the HCPs/users fit/program more gain in hearing devices, the feedback risk indicator as the background process monitors the increased gain, and if the feedback estimate and the increased gain impose a higher enough feedback risk, the HCPs/users will get noticed (or a recommendation is issued, or an action is automatically initiated), even they don't deal with feedback handling in their fitting session.

In another example use case, the HCPs/users are satisfied with the gain and there is no feedback risk. However, the HCPs/users decide to change ear piece (to be more open). The feedback risk indicator as the background process estimates a higher feedback risk and thereby a notification to HCPs/users is issued.

In a third example use case, the HCPs/users choose different settings of a directional system of the hearing device, and hence it can increase the feedback risk. The feedback risk indicator monitors the hearing device processing including the directional system as a background process, and it detects this increased feedback risk and thereby provides a notification to HCPs/users (or a recommendation is issued, or an action is automatically initiated).

In a fourth example use case, the HCPs/users choose different settings of the feedback control system of the hearing device, e.g., to obtain better sound quality. Thereby, the less effective feedback control system can be chosen, however, and by doing so there is a higher feedback risk. The feedback risk indicator monitors and detects this increased feedback risk as a background process and thereby may provide a notification to HCPs/users (or a recommendation is issued, or an action is automatically initiated), in case the indicator fulfills a high-risk criterion.

In a fifth example use case, the HCPs/users didn't manage to place the ear piece correctly and hence there is an increased feedback risk. The feedback risk indicator monitors and detects this increased feedback risk as a background process and thereby may provide a notification to HCPs/users (or a recommendation is issued, or an action is automatically initiated), in case the indicator fulfills a high-risk criterion.

Step S2 of the method may comprise

S2' evaluating said estimate of a current feedback (e.g. in relation to a feedback criterion) and providing a value of a feedback risk indicator in dependence of said estimate of a current feedback and a number of previous values of feedback.

The value of a feedback risk indicator may be an accumulated value (e.g. (possibly weighted) averaged over a number of previous values.

The method may comprise S5. repeating steps S1 to S4 over time.

Steps S1 to S4 may be repeated over time during the fitting session, e.g. during the entire fitting session.

The method may be automatically executed, at least during a part of the fitting session. The method may be continuously executed during the fitting session.

The method may be initiated by a trigger. In an embodiment, the method is initiated by the user (e.g. a user of the hearing device and/or the user of the programming device). In an embodiment, the trigger comprises a user activation, e.g. via a user interface. In an embodiment, the trigger comprises an automatically provided trigger. In an embodiment, the trigger comprises that sound above a certain level (e.g. dB SPL) is detected by the hearing system, e.g. the hearing device and/or the programming device. The trigger may be the start of execution of one or more specific modules of fitting software during the fitting session.

Step S2 of the method comprises

S2.1. Providing a visual indication of said current feedback risk indicator.

The risk indicator may be provided as an acoustic input to the user of the fitting system/method, e.g. a spoken message or one or more sounds, e.g. beeps, or as a combination of a visual and an acoustic input. The visual indication may comprise one or more of a colored or grey shaded pattern, a percentage number (e.g. 0-100%), traffic-light kind of indications (e.g. green-yellow-red), smiley type of indications (e.g. various indications from ☹ to ☺).

Step S2 of providing a value of the feedback risk indicator may comprise averaging over time and/or frequency. Step S2 may e.g. comprise averaging over time and/or frequency of a current and a number of previous values of the feedback risk indicator. Step S2 may e.g. comprise comparing said average values to a threshold value to provide said value of feedback risk.

Step S3 of determining whether said value of the feedback risk indicator fulfils a high-risk criterion may comprise one or more logical operations. Step S3 may e.g. comprise a state machine. Step S3 may e.g. comprise comparing value of the feedback risk indicator to a threshold value to decide whether it fulfills the high-risk criterion.

Step S4 of providing a warning in relation to said feedback risk may comprise a visual, an acoustic, or a mechanical indication pointing to the fulfillment of said high-risk criterion. The warning may be provided via a user interface (e.g. a display or other visual indicator, and/or a loudspeaker). The warning may be provided in the hearing device (e.g. via the output transducer, or a visual indicator on the hearing device). The warning may comprise a graphical indication, e.g. a negative smiley ☹. The warning may comprise a written indication, e.g. indicating that 'the risk of feedback should be further evaluated'. The warning may comprise an acoustic indication, e.g. one or more beeps or sounds or harmonies, or a spoken message. The warnings may be user configurable.

Step S4 of providing a recommendation in relation to said feedback risk may comprise proposing appropriate actions to manage said feedback risk. In an embodiment, proposing appropriate actions to manage said feedback risk comprises

- 'Perform specific feedback assessment', e.g. run a specific feedback manager
- 'Lower insertion gains, e.g. at certain frequencies', i.e. possibly decrease applied gain below the gain prescribed for the user's hearing impairment
- 'Use more closed fittings', i.e. reduce an effective vent size
- 'Activate feedback cancellation system or use more aggressive feedback cancellation system', e.g. increase adaptation speed of an adaptive algorithm, or temporarily decrease gain when feedback risk is above a certain level, etc.

The recommendations may be user configurable.

Step S4 of providing an action in relation to said feedback risk may comprise applying, such as automatically applying, an appropriate action to manage said feedback risk. The action to manage the feedback risk may be an action intended to reduce the feedback (and thus the feedback risk). The action to manage the feedback risk may be initiated without user intervention (e.g. without intervention of the user of the method/fitting system, e.g. an HCP).

Alternatively, the action may require user initiation, e.g. via a user interface. In an embodiment, proposing appropriate actions to manage said feedback risk comprises automatically (without user intervention) applying one of more of the proposed recommendations, e.g. to automatically

- Run a specific feedback manager
- Lower insertion gains, e.g. at certain frequencies, according to a predefined criterion
- Reduce an effective vent size, according to a predefined criterion
- Activate feedback cancellation system or use more aggressive feedback cancellation system, according to a predefined criterion.

Step S4 may comprise that said high-risk criterion is configurable. The high-risk criterion may be configured to allow a value of said feedback risk indicator providing a warning, a recommendation, and/or an action in relation to said feedback risk to be user configurable.

Step S4 may comprises that the action in relation to said feedback risk is user configurable.

A Hearing System:

In an aspect, a hearing system comprising a configurable hearing device adapted for being programmed according to a specific hearing device user's needs is provided.

The hearing device comprises

- an input transducer for picking up sound in the environment of the user and providing an electric input signal,
- an output transducer for providing output stimuli perceivable to the user as sound based on a processed version of said electric input signal;
- a configurable hearing device processor for processing said electric input signal and providing said processed version of said electric input signal.

The hearing system further comprises

- a user interface allowing a user to interact with the hearing system.

The hearing system is configured to execute the method described above, in the detailed description of embodiments and in the claims.

It is intended that some or all of the process features of the method described above, in the 'detailed description of embodiments' or in the claims can be combined with embodiments of the system, when appropriately substituted by a corresponding structural feature and vice versa. Embodiments of the system have the same advantages as the corresponding methods.

The hearing system may comprise a system to provide an estimate of, a current feedback from said output transducer to said input transducer, while the hearing device is in an operational state. This can e.g. be achieved using the feedback cancellation system with an adaptive estimation of the impulse response or a frequency response of said current feedback from output transducer to input transducer.

The user interface may form part of the hearing device, whereby the hearing device is a fully self-contained system allowing a self-fitting procedure to be executed.

The user interface may form part of a separate (auxiliary) device, e.g. a remote control device of the hearing system, e.g. embodied in a personal assistant device, e.g. a telephone, or a tablet computer, or a similar device (e.g. a smartwatch). In such case the hearing system comprises a communication interface between the hearing device and the separate device hosting the user interface. Such communication interface may be wired or wireless and be based on a standardized or proprietary protocol.

The programming device may comprise a programming device processor for executing program code of a fitting system for the hearing device, and a programming interface between the hearing device and the programming device, wherein the programming interface is configured to allow the exchange of data between the hearing device and the programming device. The hearing system (e.g. the hearing device and/or the programming device) may be configured to execute the following method steps

S1. provide an estimate of, a current feedback from said output transducer to said input transducer, while the hearing device is in an operational state;

S2. evaluate said estimate of a current feedback (e.g. in relation to a feedback criterion) and providing a value of a feedback risk indicator in dependence of said estimate of a current feedback;

S3. determine whether said value of the feedback risk indicator fulfils a high-risk criterion; and

S4. if said high-risk criterion is fulfilled to provide at least one of a warning, a recommendation, and an action in relation to said feedback risk;

wherein the hearing system is configured to automatically perform steps S1 to S4 as background processes.

The programming interface may be configured to establish a wired or wireless communication link between the hearing device and the programming device.

The hearing system may be configured to provide that said communication link is established via a network. In an embodiment, the network is the Internet. Thereby remote fitting can be facilitated.

The hearing device may comprise a feedback estimation unit configured to provide said estimate of a current feedback from the output transducer to the input transducer of the hearing device. The estimate of a current feedback may be determined by a variety of methods, e.g. using an adaptive filter. The feedback estimation unit may comprise an adaptive filter. The feedback estimation unit may be located in the hearing device and/or in the programming device.

The hearing device may comprise a feedback cancellation system configured to reduce or eliminate feedback from the output transducer to the input transducer. Feedback cancellation (or attenuation) may be implemented in a variety of ways, e.g. using feedback estimation and subtraction of a feedback estimate from a signal of the forward path (e.g. an electric input signal from the input transducer), e.g. as discussed in EP2237573A1. Other methods exist, e.g. where a signal of the forward path is modulated in gain, in case feedback is detected, cf. e.g. EP3139636A1.

The hearing device may comprise an evaluation processor configured to evaluate said estimate of a current feedback (e.g. in relation to said feedback criterion).

The programming device processor may be configured to evaluate said estimate of a current feedback in relation to said feedback criterion (e.g. a high-risk criterion). In an embodiment, steps S1 to S4 are performed in said programming device, e.g. executed by said programming device processor.

The hearing system may be configured to provide that said warning or said recommendation regarding appropriate actions to manage said feedback risk is/are provided via said user interface. The waring or recommendation may be conveyed to the hearing device user via the hearing device, e.g. as a spoken or other acoustic message (e.g. beeps or tones) or as a vibrational signal. The user interface may comprise a display, e.g. a touch sensitive display and/or a voice interface, e.g. allowing a voice control of the hearing system.

The hearing device may be constituted by, or comprise, a hearing aid, a headset, an earphone, an ear protection device or a combination thereof.

In an embodiment, the hearing system is adapted to establish a communication link between the hearing device and the programming device via the respective programming interfaces to provide that information (e.g. control and status signals, or commands, or possibly audio signals) can be exchanged or forwarded from one to the other.

A Hearing Device:

In an aspect, a configurable hearing device adapted to allow a user to program it according to a specific hearing device user's needs is provided by the present disclosure. The hearing device comprises a hearing device processor for executing program code;

a user interface allowing a user to interact with the hearing device;

wherein the program code comprises instructions for implementing the method described above in the 'detailed description of embodiments' and in the claims.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

In an embodiment, the hearing device comprises an antenna and transceiver circuitry (e.g. a wireless receiver) for wirelessly receiving a direct electric input signal from another device, e.g. from a programming device, an entertainment device (e.g. a TV-set), a communication device, a wireless microphone, or another hearing device.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment.

This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback suppression system comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing device). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$.

The update part of the adaptive filter comprises an adaptive algorithm for calculating updated filter coefficients for being transferred to the variable filter part of the adaptive filter. The timing of calculation and/or transfer of updated filter coefficients from the update part to the variable filter part may be controlled by the activation control unit. The timing of the update (e.g. its specific point in time, and/or its update frequency) may preferably be influenced by various properties of the signal of the forward path. The update control scheme is preferably supported by one or more detectors of the hearing device, preferably included in a predefined criterion comprising the detector signals.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Programming Device:

In an aspect, a programming device for programming the hearing device according to a specific hearing device user's needs is provided by the present disclosure. The programming device comprises

- a programming device processor for executing program code;
- a programming interface allowing the exchange of data between the programming device and the hearing device;
- a user interface allowing a user to interact with the programming device and/or the hearing device;

wherein the program code comprises instructions for implementing the method described above in the 'detailed description of embodiments' and in the claims.

It is intended that some or all of the process features of the method described above, in the 'detailed description of embodiments' or in the claims can be combined with embodiments of the programming device, when appropriately substituted by a corresponding structural feature and vice versa. Embodiments of the device have the same advantages as the corresponding methods.

Use:

In an aspect, use of a hearing system as described above, in the 'detailed description of embodiments' and in the claims, is moreover provided. In an embodiment, use is provided to program a hearing device.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as <hearing devices, e.g. hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids. The disclosure relates more specifically to automatic feedback risk evaluation and guidance to hearing care professionals (HCPs) (or a user) during fitting of a hearing device, e.g. a hearing aid, to a user's particular needs.

Figure 1:
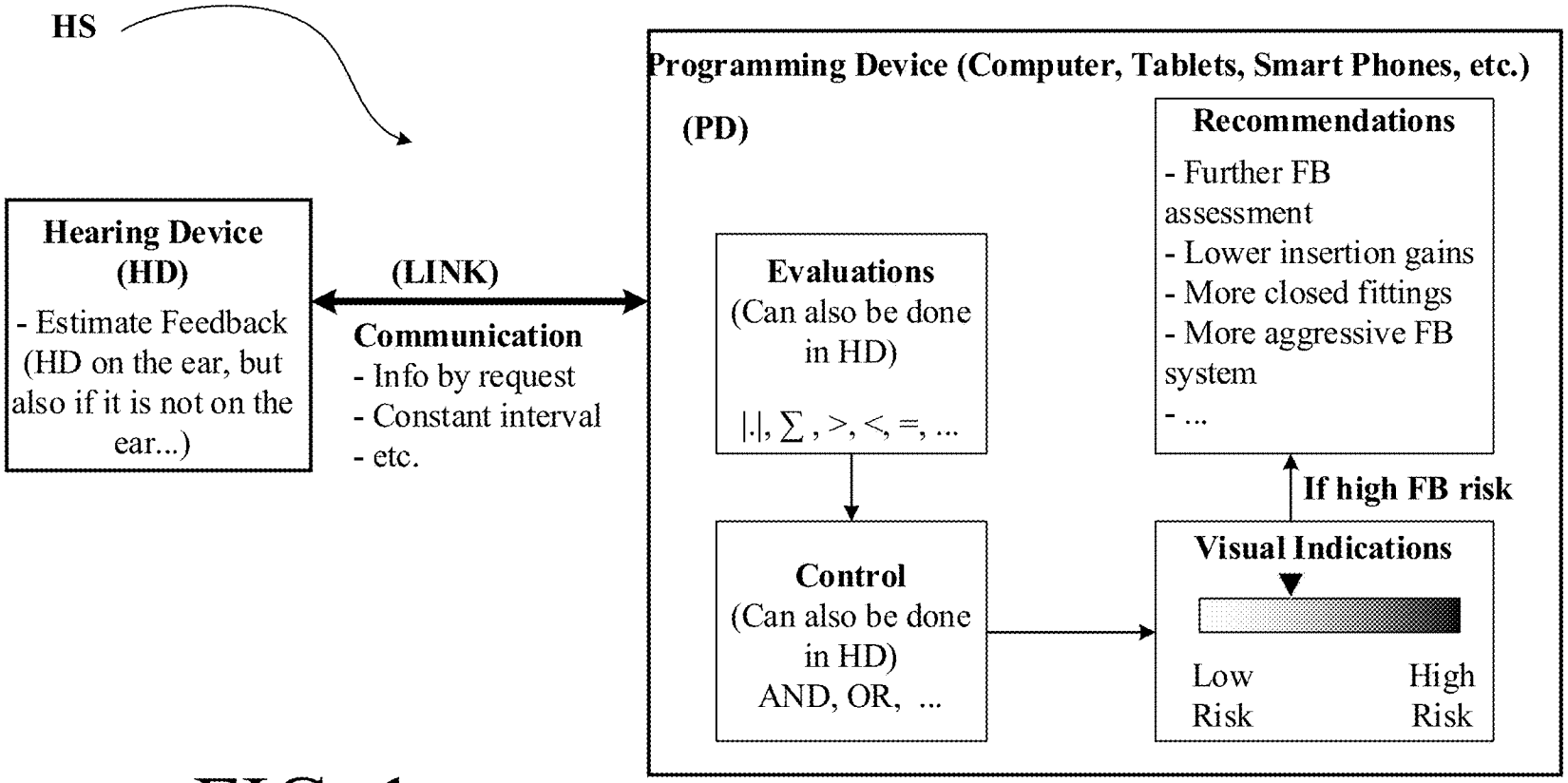
FIG. 1 shows an embodiment of a hearing system for fitting a hearing device to a particular user's needs according to the present disclosure.

FIG. 1 shows an embodiment of a hearing system for fitting a hearing device to a particular user's needs according to the present disclosure. FIG. 1 illustrates the method, which is active (running in the background), during a part of or the entire fitting session.

The background processes according to the present disclosure may be automatically initiated, e.g. via a trigger of some kind. The background processes may, however, also be manually initiated (and/or terminated).

During the fitting session loop gain of the hearing device is preferably estimated and monitored. In an embodiment, a current feedback estimate and a current request for gain (insertion gain) to compensate for a user's hearing impairment are compared to an allowable loop gain (e.g. a feedback criterion, e.g. at different frequencies) to determine a current feedback risk.

Whenever there is a high feedback risk, the HCP (or the user) is notified with warnings or recommendations on how to mitigate the feedback risk.

The hearing device (HD) should be placed on or in an end-user's ear (the concept will also work even if this is not the case, although it is likely that a high feedback risk may then be detected/shown), and the HD is configured to estimate the feedback (and thus the feedback risk). There are many ways of doing this. Information about the determined feedback risk as estimated by the hearing device (HD) is then transmitted to the programming device (PD) via a communication link (LINK) on a wired or wireless connection, e.g. via a network (such as the Internet), e.g. upon request (e.g. of a hearing care professional, e.g. forwarded to the hearing device via the programming device and the communication link), or with a specific frequency (e.g. continuously), or on the occurrence of predefined events (e.g. according to a specific criterion), etc.

The fitting device (PD) then evaluates the feedback estimate (average, threshold, over time, over frequency, etc.), before a control unit (logical operations, state machine, etc.) determines the feedback risk. Both steps involving evaluation and control can also (alternatively or additionally) be part of the HD processing.

Based on the evaluation and the control, a visual feedback risk indication is updated and shown to the HCP/end-users in the programming device. The feedback risk indication can be shown in a number of different ways and formats, e.g., a colored or grey shaded pattern (as shown in FIG. 1, cf. block Visual Indications in the programming device (PD)), a percentage number (0-100%), traffic-light kind of colors (green-yellow-red), smileys, etc.

When the feedback risk exceeds a certain predetermined threshold, the HCP/end-user will be notified with a warning and recommended feedback preventive actions are (or could be) presented to them to mitigate feedback risk. The preventive actions could be, e.g., to do more sophisticated feedback assessment, lower insertion gains, change to a more closed fitting (earpiece), and switch to more aggressive modes in feedback control system, etc.

The HCPs/end-users can also choose to ignore the feedback risk notification. They do not necessarily need to follow any recommended feedback risk mitigation.

Figure 2:
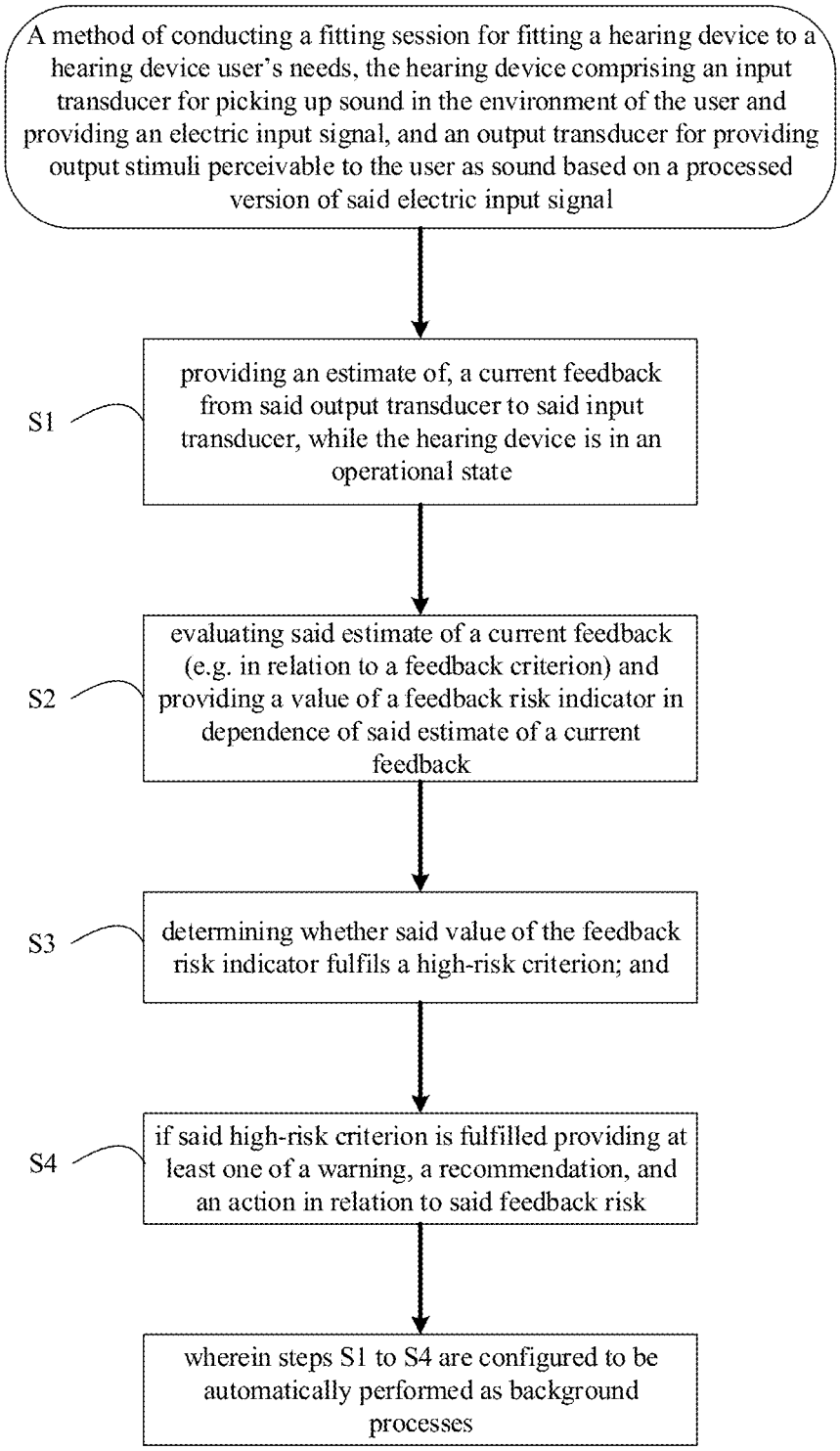
FIG. 2 shows a flow diagram for a method of fitting a hearing device to a particular user's needs according to the present disclosure.

FIG. 2 shows a flow diagram for a method of fitting a hearing device to a particular user's needs according to the present disclosure. The flow diagram illustrates a method of conducting a fitting session for fitting a hearing device to a hearing device user's needs, the hearing device comprising an input transducer for picking up sound in the environment of the user and providing an electric input signal, and an output transducer for providing output stimuli perceivable to the user as sound based on a processed version of said electric input signal. The method comprises S1. providing an estimate of, a current feedback from said output transducer to said input transducer, while the hearing device is in an operational state;

S2. evaluating said estimate of a current feedback (e.g. in relation to a feedback criterion) and providing a value of a feedback risk indicator in dependence of said estimate of a current feedback;

S3. determining whether said value of the feedback risk indicator fulfils a high-risk criterion; and S4. if said high-risk criterion is fulfilled providing at least one of a warning, a recommendation, and an action in relation to said feedback risk;

wherein steps S1 to S4 are configured to be automatically performed as background processes.

FIG. 3A-3D shows different partitions of a hearing system according to the present disclosure.

Figure 3A:
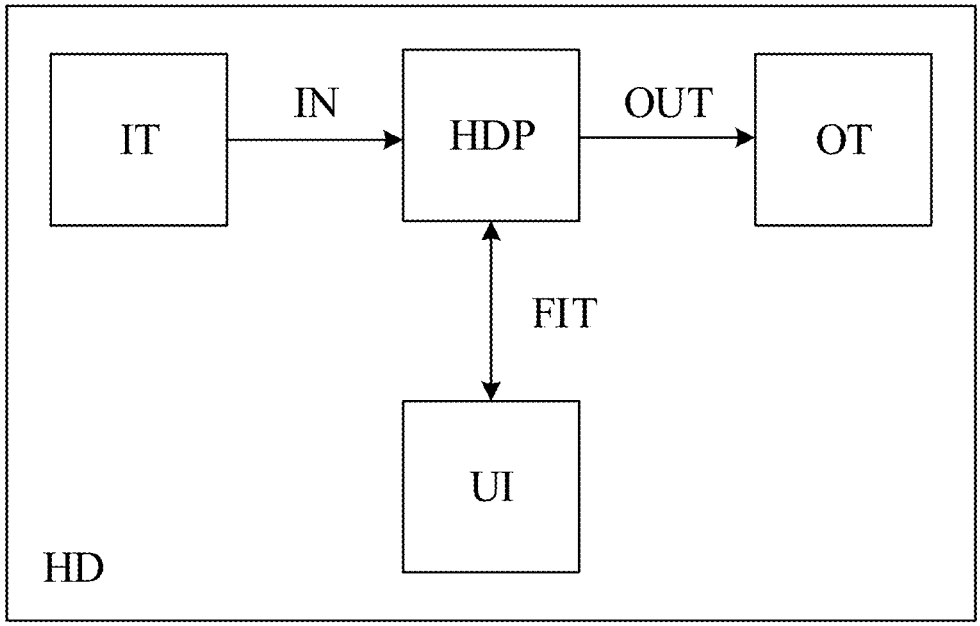
FIG. 3A shows a hearing device comprising a user interface allowing a user to adapt processing parameters of the hearing device to the user's needs.

FIG. 3A shows a hearing device (HD) comprising a user interface (UI) allowing a user to adapt processing parameters of the hearing device to the user's needs. The hearing device comprises a forward path for processing an input audio signal IN and for delivering a processed signal OUT to a user as stimuli perceivable as sound (e.g. via loudspeaker or a mechanical vibrator). The forward path comprises input transducer (IT), e.g. comprising one or more a microphones) for providing an electric input signals IN to a configurable signal hearing device processor (HDP). The configurable hearing device processor (HDP) may be adapted to a user's needs, e.g. to compensate for a hearing impairment. The hearing device processor (HDP) is configured to run fitting software as described in the present disclosure. This 'fitting procedure' may be automatically performed by the hearing device processor (HDP), possibly in communication with the user interface (UI), from which the user can at least initiate and/or acknowledge the fitting process (and possibly otherwise influence the fitting procedure), cf. signal FIT.

Figure 3B:
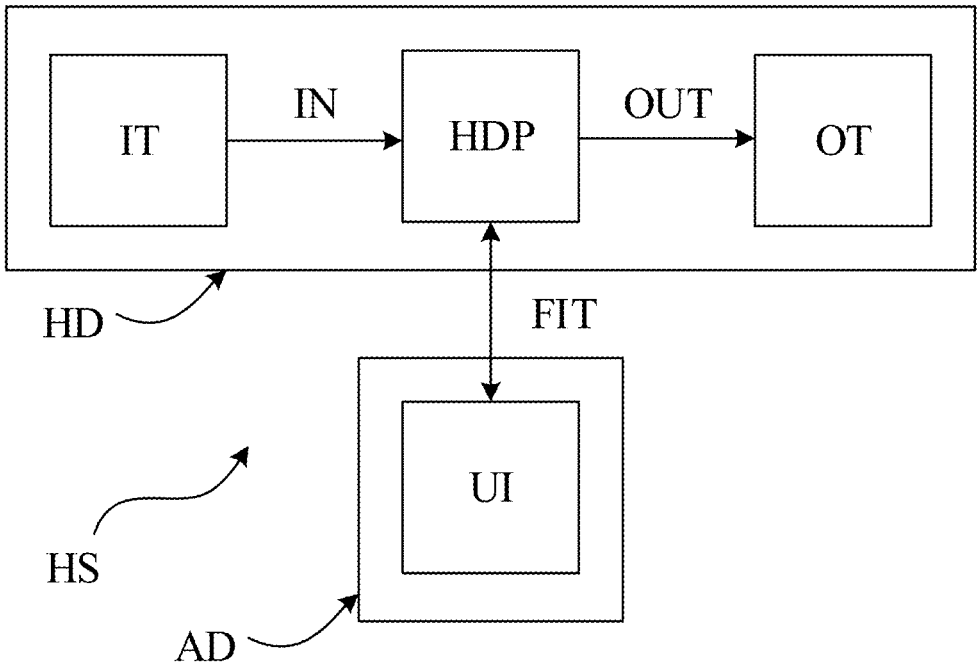
FIG. 3B shows a hearing system comprising a configurable hearing device and an auxiliary device comprising a user interface allowing a user to adapt processing parameters of the hearing device to the user's needs.

FIG. 3B shows a hearing system (HS) comprising a configurable hearing device (HD) and an auxiliary device (AD) comprising a user interface (UI) allowing a user to adapt processing parameters of the hearing device to the user's needs. The hearing device comprises a forward path as described in connection with FIG. 3A. The fitting procedure may be automatically conducted as described in connection with FIG. 3A. The auxiliary device (AD) is a separate device in wired or wireless communication with the hearing device (HD), cf. signal FIT. The auxiliary device (AD) may be a remote control device for the hearing device, or e.g. a smartphone or tablet running an APP implementing the user interface (UI).

Figure 3C:
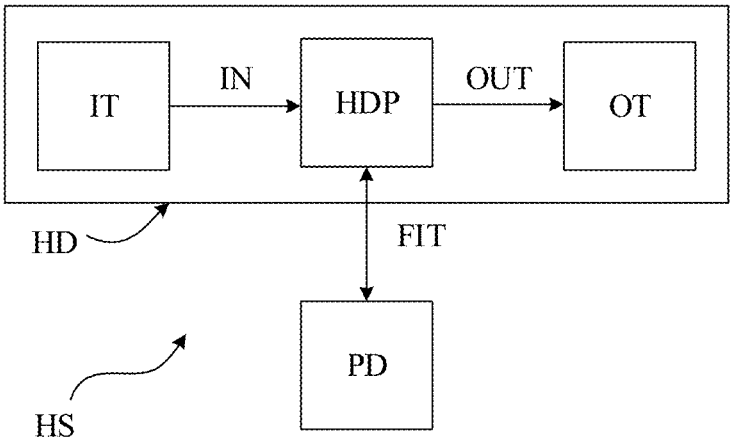
FIG. 3C shows a hearing system comprising a configurable hearing device and a programming device configured to allow a user or an HCP to adapt processing parameters of the hearing device to the user's needs.

FIG. 3C shows a hearing system (HS) comprising a configurable hearing device (HD) and a programming device (PD) configured to allow a user or an HCP to adapt processing parameters of the hearing device (HD) to the user's needs. The programming device (PD) is a separate device (e.g. a smartphone, a tablet, a laptop or other computer) running fitting software as described in the present disclosure, cf. signal FIT. The programming device (PD) and the hearing device (HD) comprises an appropriate programming interface allowing interchange of data between them including to adapt processing parameters of the hearing device processor (HDP) to the needs of the user. This partition of the hearing system (HS) may reflect a conventional fitting procedure where the hearing device user and the hearing care professional are in the same location.

Figure 3D:
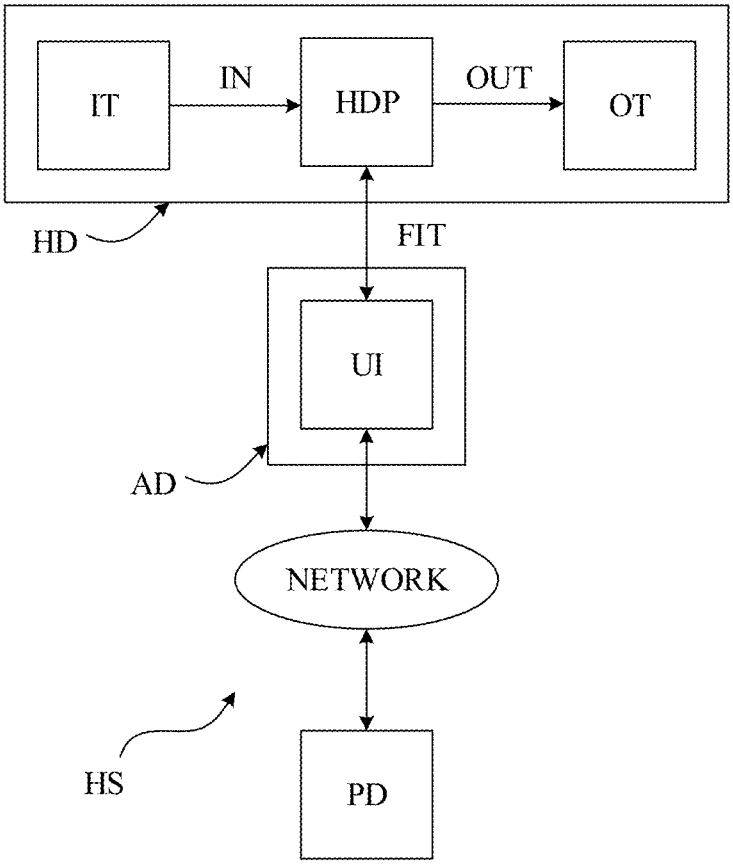
FIG. 3D shows a hearing system comprising a configurable hearing device and an auxiliary device comprising a user interface and a remotely located programming device configured to allow an HCP to adapt processing parameters of the hearing device to the user's needs via the user interface and a network.

FIG. 3D shows a hearing system (HS) comprising a configurable hearing device (HD) and an auxiliary device (AD) comprising a user interface (UI) and a remotely located programming device (PD) configured to allow an HCP to adapt processing parameters of the hearing device (HD) to the user's needs via the user interface (UI) and a network (NETWORK). This partition of the hearing system (HS) may reflect a remote fitting procedure where the hearing device user and the hearing care professional are in different physical locations (where direct visual of acoustic communication is not possible). Otherwise the procedure may be conducted as for a normal fitting procedure as in FIG. 3C, but where the user has a user interface (UI), e.g. implemented in an auxiliary device (AD), to aid (remote) communication with the HCP.

Figure 4:
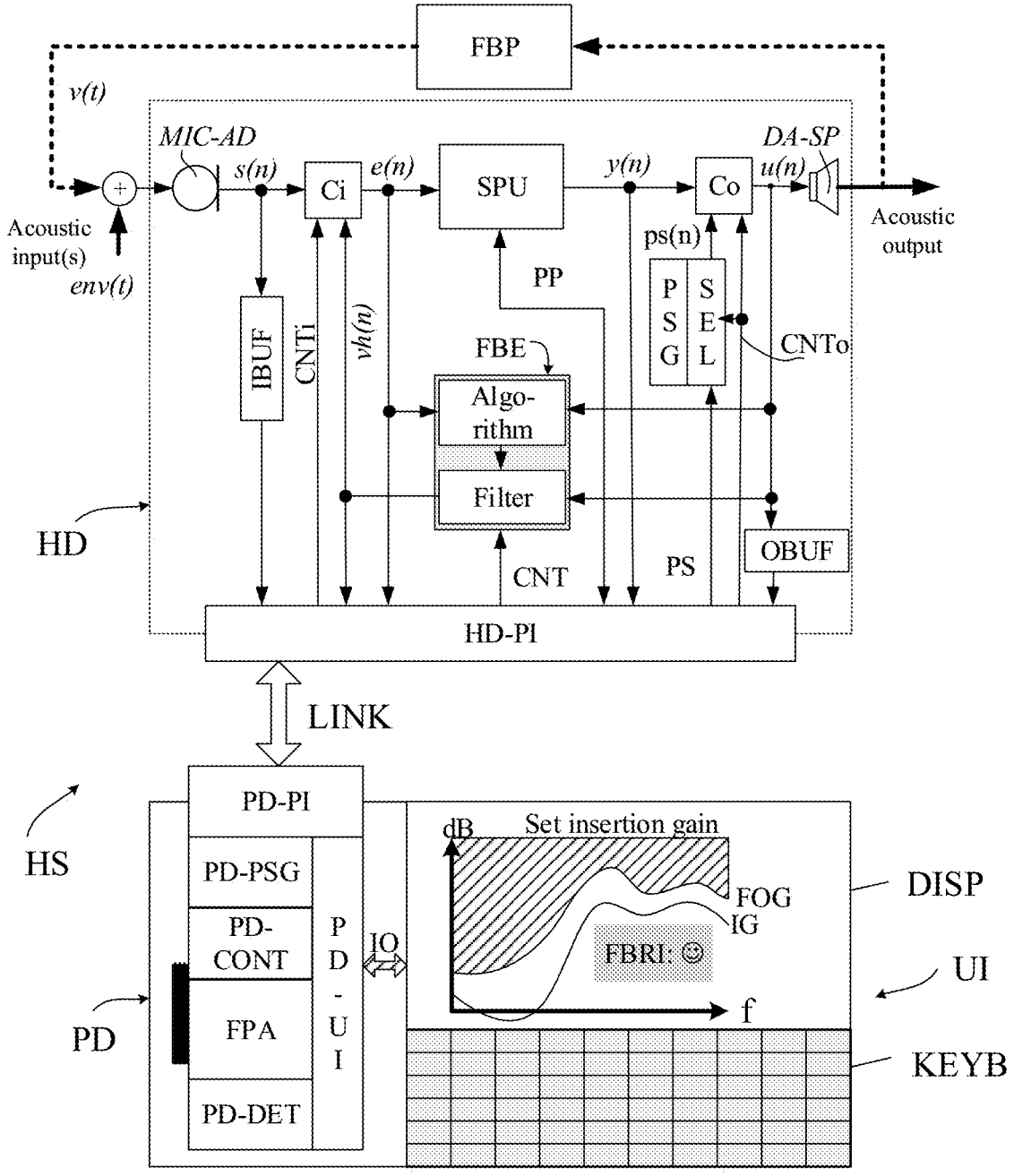
FIG. 4 shows a block diagram for a hearing system according to the present disclosure.

FIG. 4 shows a block diagram for a hearing system according to the present disclosure. FIG. 4 shows an embodiment of a hearing system (HS) comprising a hearing device (HD) and a programming device (PD) according to the present disclosure. The hearing device comprises a feedback estimation unit (FBE) for providing an estimate vh(n) of a current feedback v(t) from an output transducer (here a loudspeaker SP) to an input transducer (here a microphone MIC) of the hearing device (HD).

The hearing device (HD) of FIG. 4 comprises a combined microphone and AD-converter unit (MIC-AD) providing digital electric signal s(n) comprising digital samples of the input signal (v(t)+env(t)) at discrete points in time n. Only one microphone is shown, but a multitude of input transducers (e.g. microphones) may be used, e.g. to implement a directional system and/or a multi-microphone noise reduction system. The digital electric signal s(n) is fed to the input buffer (IBUF) for transmission to the programming device via hearing device programming interface (HD-PI) and communication link (LINK), e.g. a wired or wireless link. The forward path of the hearing device further comprises input and output combination units Ci and Co, respectively. The combination units (e.g. sum or subtraction units (or alternatively multiplication units) or more generally mixing units) allow a controlled combination or selection of inputs signals to the combination units. The forward path further comprises a signal processor (SPU) for applying a level and/or frequency dependent gain to a signal of the forward path (here e(n)) and providing a processed output signal (here y(n)). A digital to analogue converter and the output transducer are in the embodiment of FIG. 3 implemented by combined DA and speaker unit (DA-SP). In an embodiment, the forward path may comprise a filter bank allowing signal processing in the forward path to be conducted in the frequency domain. The hearing device (HD) of FIG. 4 further comprises on-board feedback estimation unit (FBE) for estimating a feedback from the input of the DA-SP unit (signal u(n)) to the output of the combination unit Ci (signal e(n)). The on-board feedback estimation unit (FBE) comprise a variable filter part (Filter) for filtering the output signal (u(n) and providing an estimate of the feedback path (signal vh(n)), e.g. under normal operation of the hearing device (where the programming device is NOT connected to the hearing device), or in a fitting procedure. The filter coefficients of the variable filter part (Filter) are determined by an adaptive algorithm (Algorithm part of the FBE unit) by minimizing the feedback corrected input signal (signal e(n)) considering the current output signal u(n). The hearing device (HD) of FIG. 4 further comprises an on-board probe signal generator (PSG) for generating a probe signal, e.g. for use in connection with feedback estimation, either performed by the on-board feedback estimation unit FBE or the feedback path analyzer (FPA) of the programming device (PD), or both. The hearing device (HD) of FIG. 4 further comprises a selection unit (SEL) operationally connected to the on-board probe signal generator (PSG) of the hearing device (HD) and to signal PS from the programming device (PD), which alternatively may provide a probe signal from the probe signal generator (PD-PSG) of the programming device. The resulting probe signal ps(n) (output of selection unit (SEL)) at a given time (n) is controllable from the programming device via the programming interface and signal CNTo. Various functional units (e.g. Ci, SPU, FBE, and SEL, Co) of the hearing device are in general controllable from the user interface (UI) of the programming device via signals (CNTi, PP, CNT, and CNTo, respectively) exchanged via the respective programming interface (HD-PI, PD-PI) and the communication link (LINK). Likewise, signals of interest in the hearing device (e.g. signals s(n), e(n), y(n) (output of signal processor SPU), and u(n) of the forward path) and feedback estimate vh(n) of the on-board feedback estimation unit (FBE) may be made available in the programming device via the programming interface. The latter can e.g. be used as a comparison for the feedback path estimate(s) made by the feedback path analyzer (FPA) of the programming device (PD), e.g. to increase validity of the value of feedback risk indicator (FBRI). Such improved feedback path measurement may e.g. be used in determining a maximum allowable gain (e.g. dependent on frequency bands) in a given acoustic situation, cf. e.g. WO2008151970A1. This may be implemented as an 'automatic action, in case the feedback risk indicator fulfils a high-risk criterion. Alternatively, a warning or a recommendation may be issued and e.g. shown to the HCP on the user interface (UI) of the programming device (PD).

The programming device may e.g. be or include a device such as Oticon FittingLink3. A programming interface may e.g. comprise a Hi-PRO interface.

The programming device is configured to execute a fitting software for configuring a hearing device (e.g. Genie™ of Oticon), in particular the hearing device processor. The frequency analyzer and other functionality of the programming device may be implemented by the fitting software.

In an embodiment, the estimate of the feedback path (FBP) is determined in the hearing device (HD). In an another embodiment, the feedback estimation is (alternatively or additionally) performed in the programming device (PD). This is indicated in FIG. 4 by the shadowed outline of the feedback path analyzer unit (FPA) in the programming device. With the data access directly in a programming device/computer, we can estimate the feedback path using different methods (either one of them or all of them), and this can (potentially) be done more quickly and/or precisely than in the hearing device, because the programming device does not have the limitations in space and power consumption (and thus processing capacity) of the hearing device (e.g. a hearing aid).

One criterion for selecting which processing method to use at a given point in time could be based on (or influenced by) the inputs from one or more detectors, e.g. an estimate of the background noise level. Preferably, the hearing device and/or the programming device comprises a detector or estimator of the current noise level (cf. detector unit PD-DET in the programming device PD of FIG. 4). With a low background noise level, one could, e.g., apply the system identification method using a perfect sequence, which provides the shortest estimation time (cf. e.g. EP3002959A1). On the other hand, with a relatively high background noise, one can use the sine sweep method or the deterministic method with matrix inversion, which are more robust against noisy background but takes longer time for the processing (or any other appropriate method).

In an embodiment, the hearing system is configured to use more than one algorithm to determine the final feedback path estimation. Having results from different algorithms, the measurement quality can be determined by analyzing the differences between the obtained results. Furthermore, the obtained results can be used to determine one final result, e.g., by averaging or discarding some of the results. A re-measurement can also be performed based on the analysis.

Thereby a more qualified feedback risk assessment can be performed (as a background process).

The programming device (PD) of FIG. 4 further comprises a configurable probe signal generator PD-PSG for generating a probe signal for use in a feedback path measurement of the feedback path analyzer (FPA). Further, the feedback path analyzer unit (FPA) of FIG. 4 is configurable to allow the selection of feedback estimation algorithm from a multitude of algorithms (as indicated by the shadowed outline of the FPA unit). The programming device (PD) of FIG. 4 further comprises a detector unit (PD-DET) comprising one or more detectors, e.g. a correlation detector or a noise level detector, or a feedback detector, etc., for providing an indicator of one or more parameters of relevance for controlling the feedback path analyzer unit (FPA), e.g. a choice of feedback estimation algorithm and/or whether a value of the feedback risk indicator fulfils a high-risk criterion. The interface (IO) to the user interface (UI) (comprising display (DISP) and keyboard (KEYB)) allowing exchange of data and commands between the fitting system user and the programming device is indicated by double (hatched) arrow denoted IO.

The exemplary display (DISP) screen of the programming device of FIG. 4 shows a situation where a user (e.g. an audiologist or the user himself) is in a gain setting mode (see headline 'Set insertion gain'), where the user sets relevant (frequency dependent) gains for compensating for a hearing impairment of the hearing device user (i.e. fitting the hearing device to the user). A feedback risk indicator (FBRI) determined in background processes as proposed by the present disclosure is here shown by smiley ☺, indicating a low risk feedback condition (given the present definitions of the fitting system).

Figure 5:
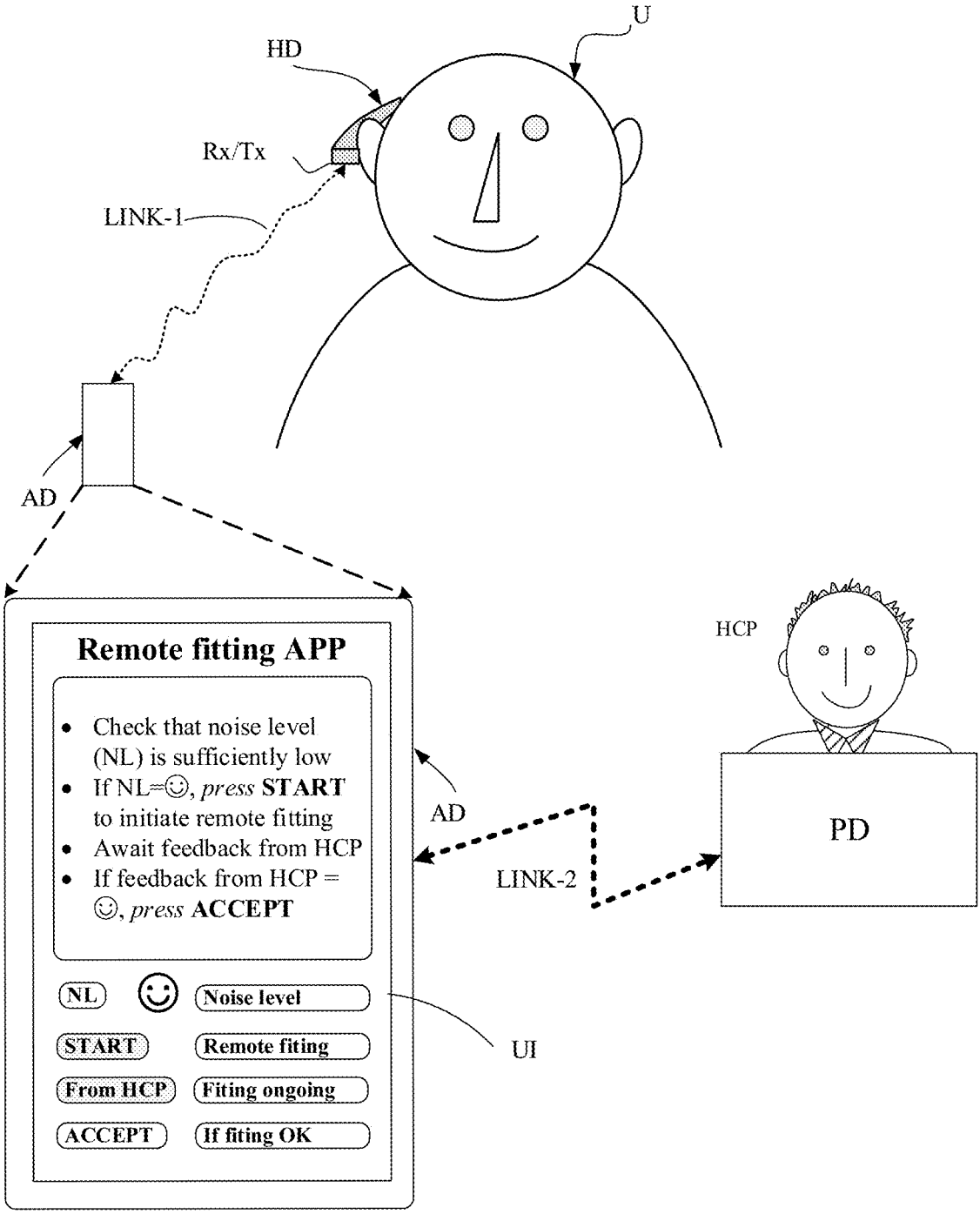
FIG. 5 shows a block diagram for a hearing system comprising an APP running on an auxiliary device and configured as a user interface for the hearing device user allowing a remote fitting session to be carried out by an HCP using a programming device, via a network.

FIG. 5 shows a block diagram for a hearing system (HS) comprising a hearing device (HD) and an APP (cf. 'Remote fitting APP' in FIG. 5) running on an auxiliary device (AD), e.g. a smartphone, and configured as a user interface (UI) for the hearing device user (U) allowing a remote fitting session to be carried out by a remotely located hearing care professional (HCP) using a programming device (PD), e.g. via a network (LINK-2) and a link (LINK-1) between the auxiliary device (AD) and the hearing device (HD). The hearing system is configured to allow the HCP to control a fitting session, where the processor of the hearing device is configured to the user's (U) needs, including setting appropriate gains that compensate for the user's hearing impairment while minimizing a risk of feedback howl during normal use of the hearing device. The system is configured to monitor the feedback situation in background processes according to the present disclosure. FIG. 5 shows a screen of the 'Remote fitting APP', where the top part of the screen contains instructions to the user regarding the fitting session:

Check that (background) noise level (NL) is sufficiently low.

If NL=☺, press START to initiate remote fitting.

Await feedback from HCP.

If feedback from HCP=☺, press ACCEPT.

In the lower part of the screen of the exemplified 'Remote fitting APP', a number of information/action fields ('activation buttons') are located allowing a user to

- monitor a noise level in the environment (press 'NL' to get an updated estimate of the Noise level),
- initiate a remote fitting session (press 'START', in case the noise level is acceptable, ☺),
- receive status messages from the HCP (press 'From HCP' updates information from the HCP, here 'Fitting ongoing'). By clicking twice, a screen is shown with more detailed information about the current activities of the fitting session.
- Accept the result of the fitting when information has been received that the fitting session has been successfully concluded (press 'Accept' If fitting is OK).

The second link (LINK-2) between the auxiliary device (AD) and the programming device (PD) may e.g. comprise a point to point communication link, e.g. based on a standardized link protocol, e.g. Bluetooth, or the like. The second link (LINK-2) may e.g. comprise a network, e.g. a data network, such as the Internet, or based on WLAN, or the like. The first link (LINK-1) between the auxiliary device (AD) and the hearing device (HD) may e.g. comprise a point to point communication link, e.g. based on a standardized or proprietary link protocol, e.g. Bluetooth, or the like, or a protocol based on near-field communication (e.g. inductive coupling). The hearing device (HD) and the auxiliary device (AD) each comprise appropriate antenna and transceiver circuitry (cf. unit Rx/Tx in the hearing device (HD) of FIG. 5) allowing appropriate communication between the auxiliary device (and the programming device) and the hearing device (including the transfer of parameter settings and possibly audio signals and/or information and control signals) to be conducted.

In an embodiment, the auxiliary device comprises a loudspeaker configured to play a sound scene to the user while wearing the hearing device in an operational mode (e.g. controlled by the HCP from the programming device). In an embodiment, the hearing system comprises an external loudspeaker (e.g. a Bluetooth loudspeaker or a loudspeaker otherwise (wirelessly or wired) connected to the auxiliary device and/or to the programming device, allowing a sound scene to be played for the user via the loudspeaker (e.g. controlled by the HCP). In an embodiment, the hearing system is configured to allow a sound scene to be played via an output transducer of the hearing device, e.g. in the sound scene is streamed to the hearing device from the (or via the) auxiliary device, while the input transducer (microphone) is on allowing it to pick up feedback from the output transducer (loudspeaker).

During a fitting session—different sound scenes may be played via an external loudspeaker (or a set of loudspeakers) at different levels that might provoke feedback problems. Additionally, the user may be asked to perform acts that makes sudden changes the feedback path, etc., to provoke the feedback handling system of the hearing device, and thus to allow the system to (realistically) monitor a feedback risk for the given user (with a given need for gain) and the given hearing aid style (open fitting with dome or closed fitting with ear mould, etc.).

In an embodiment, sounds are NOT played via external loudspeaker(s). It may be preferred to keep the 'test environment' relatively quiet, to get the best accuracy of the feedback risk indictor. Using stimulation sound from external loudspeakers or only sound from the hearing aid loudspeaker(s), or a mixture, may be a matter of choice depending on the feedback estimation/cancellation principle used by the particular hearing device in question. Some feedback cancellation systems are very accurate to estimate a critical feedback situation, even in low quiet environment, whereas the use of external signals at high levels and/or musical signals may result in the feedback risk indicator to be less accurate (induce more false detections).

Figure 6:
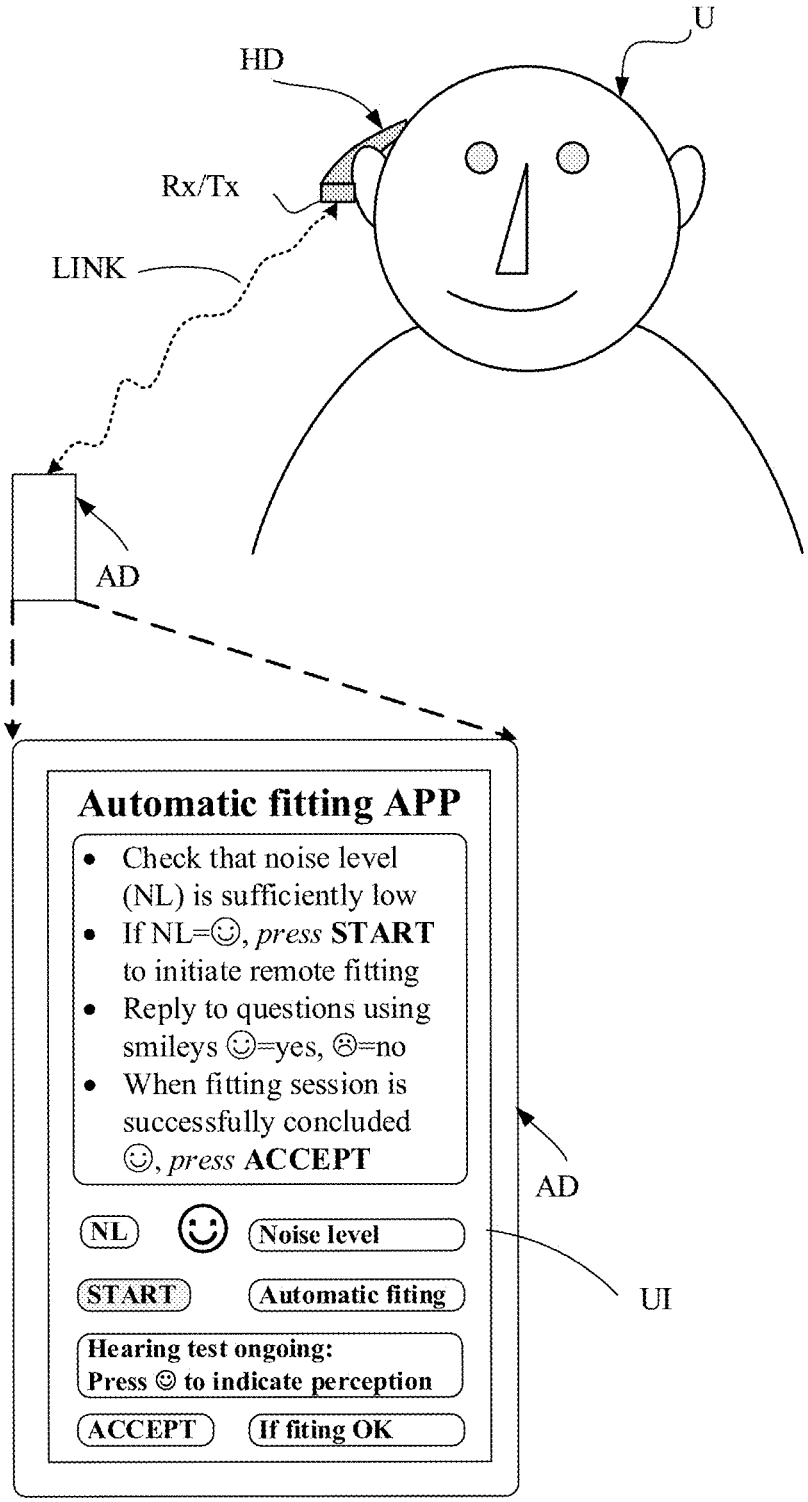
FIG. 6 shows a block diagram for a hearing system comprising an APP running on an auxiliary device and configured as a user interface for the hearing device user allowing an automatic fitting session to be carried out, and FIG. 7 schematically illustrates the feedback loop of a hearing device comprising an electric forward path from input to output transducer, and an acoustic (and/or mechanical) feedback path from output to input transducer.

FIG. 6 shows a block diagram for a hearing system (HS) comprising a hearing device (HD) and an APP (cf. 'Automatic fitting APP' in FIG. 6) running on an auxiliary device (AD), e.g. a smartphone, and configured as a user interface (UI) for the hearing device user (U) allowing a fitting session to be carried out by the user or 'automatically' by the system guiding the user. The hearing system is configured to establish a link (LINK) between the auxiliary device (AD) and the hearing device (HD) via appropriate antenna and transceiver circuitry in the devices (cf. Rx/Tx in the hearing device (HD)).

The hearing system is configured to monitor the feedback situation in background processes according to the present disclosure. FIG. 6 shows a screen of the 'Automatic fitting APP', where the top part of the screen contains instructions to the user regarding the fitting session:

Check that noise level (NL) is sufficiently low.

If NL=☺, press START to initiate remote fitting.

Reply to questions using smileys ☺=yes, ☹=no.

When fitting session is successfully concluded ☺, press ACCEPT.

In the lower part of the screen of the exemplified 'Automatic fitting APP', a number of information/action fields ('activation buttons') are located allowing a user to monitor a noise level in the environment (press 'NL' to get an updated estimate of the Noise level), initiate an automatic fitting session (press 'START', in case the noise level is acceptable, ☺), receive status messages from the system ('Hearing test ongoing. Press ☺ to indicate perception).

Accept the result of the fitting when information has been received that the fitting session has been successfully concluded (press 'Accept' If fitting is OK).

Otherwise the system of FIG. 6 may have the same features as discussed in connection with FIG. 5 and/or FIG. 4.

Figure 7:
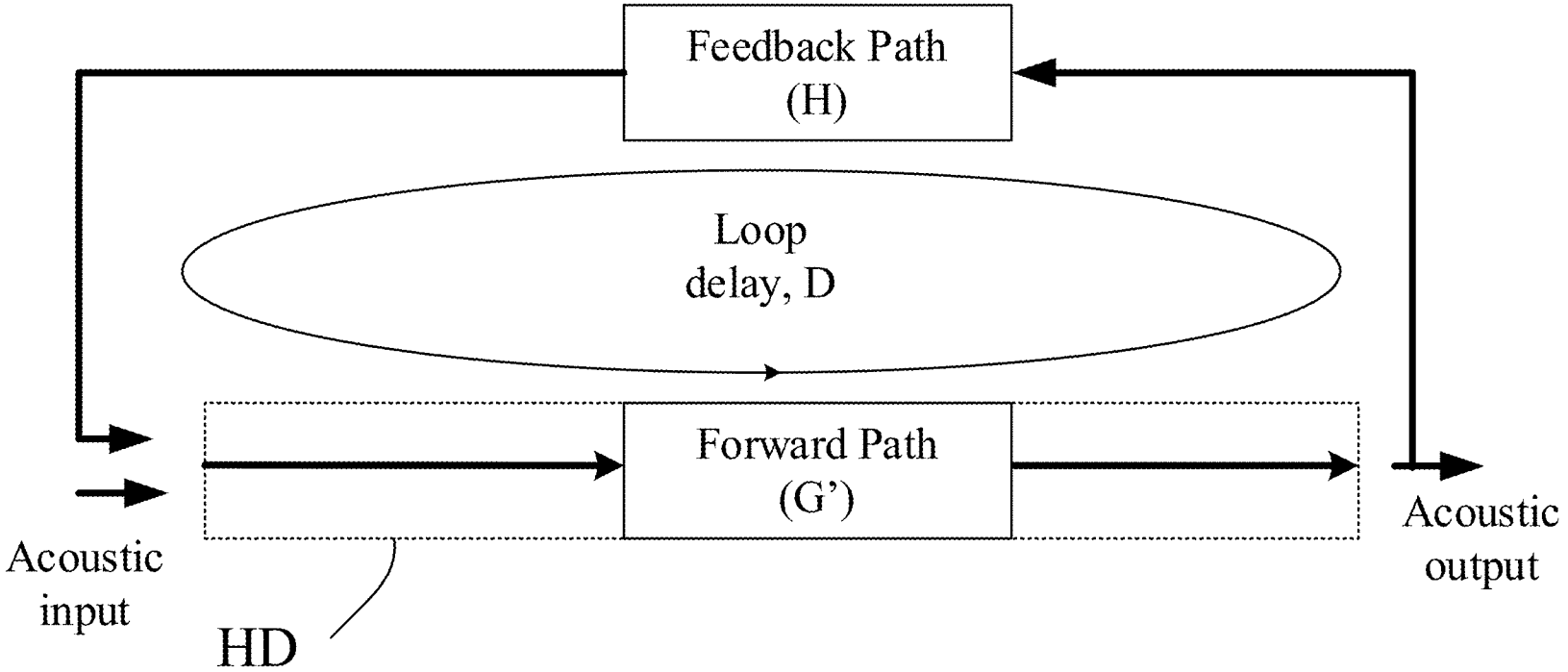

FIG. 7 schematically illustrates the feedback loop of a hearing device (HD) comprising an electric forward path from input to output transducer, and an acoustic (and/or mechanical) feedback path from output to input transducer. The feedback loop is represented by the electric forward path of the hearing device from the input transducer to the output transducer and an acoustic feedback path from the output transducer to the input transducer. The forward path (ideally) provides a (frequency and level dependent) desired gain G (typically an amplification) according to the needs of a user. The feedback path exhibits a feedback gain H (typically a frequency dependent attenuation). Hence, loop gain, LG, is determined as a sum of the desired forward path gain G and the feedback gain H (in a logarithmic representation, LG=G+H), cf. e.g. FIG. 7. The loop gain may be determined for any signal of the forward path (e.g. the electric input signal (IN), the processed output signal (OUT), or any signal tapped therebetween (IN')). A criterion for build-up of feedback in the hearing device includes that loop gain is larger than 1 (0 dB in a logarithmic representation). Hence, for given values of feedback (the current feedback estimate Hest) and desired gain (gain G provided by the forward path) a current risk of feedback can be evaluated (a high-risk criterion being e.g. LG≥0 dB).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2237573A1 (OTICON) 6 Oct. 2010
EP3139636A1 (OTICON) 8 Mar. 2017
EP3002959A1 (OTICON) 6 Apr. 2016
WO2008151970A1 (OTICON) 18 Dec. 2008

The invention claimed is:

1. A method of conducting a fitting session for fitting a hearing device to a hearing device user's needs, the hearing device comprising an input transducer for picking up sound in the environment of the user and providing an electric input signal, and an output transducer for providing output stimuli perceivable to the user as sound based on a processed version of said electric input signal, the method comprising S1. providing an estimate of a current feedback from said output transducer to said input transducer, while the hearing device is in an operational state;

S2. evaluating said estimate of a current feedback and providing a value of a feedback risk indicator in dependence of said estimate of a current feedback;

S3. determining whether said value of the feedback risk indicator fulfils a high-risk criterion, a fulfillment of said high-risk criterion being dependent of said estimate of the current feedback; and S4. if said high-risk criterion is fulfilled, providing at least one of a warning and a recommendation to a hearing care professional and/or to the user in relation to said feedback risk;

wherein steps S1 to S4 are configured to be automatically performed as background processes, said background processes being executed by a computer without a user's active involvement, and wherein step S3 of determining whether said value of the feedback risk indicator fulfils a high-risk criterion comprises one or more logical operations related to said estimate of the current feedback.

2. A method according to claim 1 wherein step S2 comprises

S2' evaluating said estimate of a current feedback and providing a value of a feedback risk indicator in dependence of said estimate of a current feedback and a number of previous values of said feedback estimate.

3. A method according to claim 1 comprising

S5. repeating steps S1 to S4 over time.

4. A method according to claim 1 being automatically executed, at least during a part of the fitting session.

5. A method according to claim 1 wherein step S3 of determining whether said value of the feedback risk indicator fulfils a high-risk criterion comprises one or more logical operations.

6. A method according to claim 1 wherein step S4 of providing a warning in relation to said feedback risk comprises, a visual, an acoustic or a mechanical indication of fulfillment of said high-risk criterion.

7. A method according to claim 1 wherein step S4 comprises that said high-risk criterion is configurable.

8. A method according to claim 1 wherein step S4 comprises that the action in relation to said feedback risk is user configurable.

9. A method according to claim 1 wherein said high-risk criterion further depends on a current desired forward path gain.

10. A hearing system comprising a hearing device adapted for being programmed according to a specific hearing device user's needs, the hearing device comprising an input transducer for picking up sound in the environment of the user and providing an electric input signal, an output transducer for providing output stimuli perceivable to the user as sound based on a processed version of said electric input signal;

a configurable hearing device processor for processing said electric input signal and providing said processed version of said electric input signal, and the hearing system further comprising a user interface allowing a user to interact with the hearing system, wherein the hearing system is configured to execute the method of claim 1.

11. A hearing system according to claim 10 comprising a programming device comprising a programming device processor for executing program code of a fitting system for the hearing device, and a programming interface between the hearing device and the programming device, wherein the programming interface is configured to allow the exchange of data between the hearing device and the programming device.

12. A hearing system according to claim 11 wherein said programming interface is configured to establish a wired or wireless communication link between the hearing device and the programming device, e.g. via a network.

13. A hearing system according to claim 10 wherein the hearing device comprises a feedback estimation unit configured to provide said estimate of a current feedback from the output transducer to the input transducer of the hearing device.

14. A hearing system according to claim 10 wherein the hearing device comprises a feedback cancellation system configured to reduce or eliminate feedback from the output transducer to the input transducer.

15. A hearing system according to claim 10 wherein the hearing device comprises an evaluation processor configured to evaluate said estimate of a current feedback in relation to said high-risk criterion.

16. A hearing system according to claim 11 wherein said programming device processor is configured to evaluate said estimate of a current feedback in relation to said high-risk criterion.

17. A hearing system according to claim 10 wherein the hearing system is configured to provide that said warning or said recommendation regarding appropriate actions to manage said feedback risk is/are provided via said user interface.

18. A hearing system according to claim 10 wherein said hearing device is constituted by or comprises a hearing aid.

19. A data processing system comprising a processor and program code means for causing the processor to perform the method of claim 1.

20. A computer program comprising instructions which, when the program is executed by a computer, cause the computer to carry out the method of claim 1.

21. A method according to claim 1 wherein, in order to determine whether said high risk criterion is fulfilled, c a current loop gain is compared to specific values, where loop gain (LG) is defined as $$LG=G+H_{est},$$

where G is the current desired forward path gain and $H_{est}$ is the current estimated feedback path gain in a logarithmic representation.

22. A method according to claim 1 wherein, during the fitting session, settings of a directional system of the hearing device are changed, the feedback risk indicator monitors the hearing device processing including the directional system as a background process, and if it detects an increased feedback risk, a notification or a recommendation is issued.

23. A method according to claim 1 wherein, during the fitting session, settings of a feedback control system of the hearing device are changed, and the feedback risk indicator monitors and detects an increased feedback risk as a background process, providing a notification or a recommendation in case the indicator fulfills the high-risk criterion.

24. A method according to claim 1 wherein the fitting session comprises a number of different fitting stages, which are not all directly related to feedback, but where the feedback risk detection is run as a background process in all these fitting stages, without being visible or noticeable to the health care professional and/or the user unless the feedback risk detection estimates a high feedback risk, in which case the hearing care professional and/or the user are made aware of the high feedback risk, and mitigation actions are recommended.

25. A method according to claim 1 wherein, during the fitting session, the hearing care professional and/or the user request more gain in the hearing device, the feedback risk indicator monitors the increased gain as the background process, and if the feedback estimate and the increased gain impose a sufficiently-high feedback risk, the hearing care professional and/or to the user is notified that the feedback risk indicator fulfills a high-risk criterion.

26. A method according to claim 1 wherein if the hearing care professional and/or the user decide to change an ear piece to be more open, the feedback risk indicator as the background process estimates a higher feedback risk, and thereby a notification to the hearing care professional and/or to the user is issued, in case the feedback risk indicator fulfills a high-risk criterion.

27. A method according to claim 1 wherein the hearing care professional and/or the user change settings of a directional system of the hearing device, and hence potentially increase the feedback risk, the feedback risk indicator monitors the hearing device processing including the directional system as a background process, and if it detects an increased feedback risk provides a notification to the hearing care professional and/or the user, in case the feedback risk indicator fulfills a high-risk criterion.

28. A method according to claim 1 wherein the hearing care professional and/or the user change settings of the feedback control system of the hearing device, thereby choosing a less effective feedback control system, and by doing so imposing a higher feedback risk, the feedback risk indicator monitoring and detecting the increased feedback risk as a background process and providing a notification to the hearing care professional and/or the user, in case the indicator fulfills a high-risk criterion.

29. A method according to claim 1 wherein, in case the hearing care professional and/or the user did not manage to place the ear piece correctly, and hence there is an increased feedback risk, the feedback risk indicator monitors and detects this increased feedback risk as a background process and thereby provides a notification to the hearing care professional and/or the user, in case the indicator fulfills a high-risk criterion.

* * * * *